US005877789A

United States Patent [19]

Reinten

[11] Patent Number: 5,877,789

[45] Date of Patent: Mar. 2, 1999

[54] ACOUSTIC PRESSURE WAVE PROPAGATING INK-SYSTEM

[75] Inventor: Hans Reinten, BD Velden, Netherlands

[73] Assignee: Océ-Nederland B.V., Ma Venlo, Netherlands

[21] Appl. No.: 662,139

[22] Filed: Jun. 12, 1996

[30] Foreign Application Priority Data

Jun. 12, 1995 [EP] European Pat. Off. ..... 95201536

[51] Int. Cl.[6] ..... B41J 2/14; B41J 2/16

[52] U.S. Cl. ..... 347/48; 347/10; 347/70

[58] Field of Search ..... 347/48, 68, 70, 347/10, 11, 12, 13, 54

[56] References Cited

U.S. PATENT DOCUMENTS

| | | | |
|---|---|---|---|
| 4,190,783 | 2/1980 | Massa | 310/324 |
| 4,364,069 | 12/1982 | Kobayashi | 347/71 |
| 4,523,199 | 6/1985 | Ott | 347/68 X |
| 4,525,728 | 6/1985 | Koto | 347/70 |
| 4,672,398 | 6/1987 | Kuwabara et al. | 347/68 X |
| 5,657,063 | 8/1997 | Takahashi | 347/69 |

FOREIGN PATENT DOCUMENTS

| | | | |
|---|---|---|---|
| 0072685 | 2/1982 | European Pat. Off. | B41J 3/04 |
| 0214855 | 3/1987 | European Pat. Off. | B41J 3/04 |
| 402172 | 6/1990 | European Pat. Off. . | |
| 0608135A2 | 7/1994 | European Pat. Off. | B41J 2/065 |
| 0608135A3 | 7/1994 | European Pat. Off. | B41J 2/065 |
| 4328433 | 3/1995 | Germany . | |
| 60-011369 | 1/1985 | Japan | B41J 3/04 |
| 61-25849 | 2/1986 | Japan | 347/48 |
| 62-225364 | 10/1987 | Japan | 347/48 |
| 2104006 | 3/1983 | United Kingdom | B41J 3/04 |

OTHER PUBLICATIONS

'1985 Sid International Symposium, Digest 1–8 of Technical Papers, May 1985, pp. 317–320.

IBM Technical Disclosure Bulletin, vol. 26, No. 10B, Mar. 1984, pp. 5646–5647.

*Primary Examiner*—N. Le
*Assistant Examiner*—C. Dickens

[57] ABSTRACT

Ink-jet system includes an ink channel between an ink reservoir and a nozzle. A pressurizing device is arranged adjacent to the ink channel for generating in the ink liquid an acoustic pressure wave propagating in the ink channel, so that an ink droplet is expelled from the nozzle. The ink channel has a substantially rectangular cross section and a depth d which is larger than the height of the nozzle, such that energy losses due to reflection of the acoustic wave at the transition from the ink channel to the nozzle are minimized. The pressurizing device includes a first electromechanical transducer with a plate-like expansible member having a height H in the direction of the depth of the ink channel such that the ratio H/d is smaller than the ratio between the respective elastic modules of the expansible member and the ink liquid. At least one second electromechanical transducer is arranged at said ink channel and is energized to create a pressure bias in the ink volume before the same is pressurized by the first transducer.

24 Claims, 2 Drawing Sheets

ACOUSTIC PRESSURE WAVE PROPAGATING INK-SYSTEM

BACKGROUND OF THE INVENTION

1. Field of the Invention

The invention relates to an ink-jet system which includes an ink channel disposed between an ink reservoir and a nozzle. A pressurizing device is arranged adjacent to the ink channel for generating in the ink liquid an acoustic pressure wave propagating in the ink channel, so that an ink droplet is expelled from the nozzle.

2. Description of Background Art

Ink-jet systems are used as printheads in ink-jet printers. A drop-on demand ink-jet system of the type indicated above is disclosed, for example, in EP-A1-0 402-172. In this system, the ink channel is formed in a substrate which is sandwiched between a bottom plate and a cover plate such that the top and bottom surfaces of the ink channel are formed by the cover plate and the bottom plate, respectively. The ink channel has a constant depth which is identical to the height of the nozzle, but has a larger width than the nozzle and is tapered at its front end so that its width is gradually reduced to that of the nozzle. The pressurizing device comprises a plate-like piezoelectric element which is disposed underneath the bottom plate within the area of the ink channel. The piezoelectric element is supported on a rigid support plate and has its top end face directly engaged with the bottom plate of the ink channel. When an electric voltage is applied to the electrodes of the piezoelectric element, the piezoelectric material expands in a vertical direction, and the elastic bottom plate is flexed inwardly of the ink channel, so that an ink droplet is expelled from the nozzle.

In a practical print head for high-speed and high-resolution printing, a plurality of ink-jet systems are integrated on a common substrate. In order to achieve objectives such as large-scale integration, a high maximum frequency of drop generation and the like, the ink-jet systems should be made as compact as possible. On the other hand, the ink jet systems should be operable with moderate voltages and must nevertheless be capable of providing a sufficient energy for creating droplets of a suitable size and accelerating them to a suitable speed so that the droplets may be deposited on the recording medium with high accuracy. It is therefore desirable to optimize the efficiency, with which the mechanical energy provided by the piezoelectric element is converted into kinetic energy of the droplet.

The total energy efficiency depends largely on the following two factors: (1) the efficiency with which the mechanical energy of the piezoelectric element is converted into energy of an acoustic wave propagating in the ink liquid and (2) the efficiency with which the acoustic energy is conferred to the droplet created at the nozzle.

The first factor is determined by the ratio between the thickness of the piezoelectric element and the depth of the ink channel. Ideally, this ratio should not be much smaller than the ratio between the elastic modules of the piezoelectric material and the ink liquid. Since the piezoelectric material generally has a comparatively large elastic module and, on the other hand, the thickness of this element is limited by practical constraints, this factor requires a rather small depth of the ink channel.

The second factor depends on the ratio between the sectional areas of the nozzle and the ink channel. Ideally, this ratio should be so selected that an optimal "impedance match" is provided for the acoustic wave, in order to avoid energy losses by reflection of the acoustic wave. Since the cross-section of the nozzle is determined by the desired size of the droplets and the width of the ink channel should not be made too large, a comparatively large depth of the ink channel would be desirable in view of this factor.

Thus, when the depth of the ink channel is determined, a compromise between the two above-mentioned factors must be made, with the result that the total energy efficiency remains rather poor.

IBM Technical Disclosure Bulletin Vol. 26, No. 10B, March 1984, discloses a different type of ink-jet system in which the ink channel is defined in the interior of a tubular piezoelectric element. The outer circumferential surface of the tubular piezoelectric element is surrounded by a plurality of discrete annular conducting bands which serve as energizing electrodes, so that a plurality of piezoelectric transducers are formed which are distributed over the length of the ink channel. If the excitation of each transducer is timed properly, a pressure wave travelling towards the nozzle in the ink channel will build up its energy as it passes under each transducer.

However, an ink-jet system of this type is difficult to manufacture, and it is particularly difficult to integrate a plurality of ink-jet systems of this type into a multiple-nozzle printhead for high-speed and high-resolution printing. In addition, since the plurality of conducting bands of each piezoelectric element in each individual ink-jet system must be energized separately, a complicated control logic is required, and the wiring system needed for applying the appropriate voltages to the individual conducting bands becomes very complex when the number of nozzles in the integrated printhead is increased.

SUMMARY AND OBJECTS OF THE INVENTION

It is an object of the invention to provide an ink-jet system which has a simple structure and is nevertheless capable of providing a high energy efficiency.

According to the invention, this object is achieved in an ink-jet system which includes an ink reservoir and a nozzle. A pressurizing device is arranged adjacent to the ink channel for generating in the ink liquid an acoustic pressure wave propagating in the ink channel so that an ink droplet is expelled from the nozzle wherein the transducers are energized by nested pulses such that the transducers sequentially arranged along the ink channel are contracted one after the other in the order from the nozzle towards the ink reservoir and are then expanded one after the other in reverse order.

Because of the rectangular cross-section of the ink channel and the plate-like shape of the expansible member of the transducer, the ink-jet system is easy to manufacture and can readily be integrated in a multiple-nozzle printhead. In order to optimize the energy efficiency, the depth d of the ink channel is selected in view of an optimal ratio between the cross-sectional areas of the ink channel and the nozzle, whereas the ratio H/d is allowed to deviate from the theoretical optimum. However, it can be shown that, by creating a pressure bias in the ink volume which is subject to the compression stroke of the first transducer, this theoretical optimum is shifted towards smaller values of H/d, so that a high total energy efficiency can be achieved.

The use of two or more transducers creates a synergetic effect, which means that, when the voltage to be applied to the transducers is given, the kinetic energy conferred to the droplet is larger than would be required if the two or more transducers were replaced by a single one with the same total dimensions. The reason is that the pressure bias created by the second transducer enhances the efficiency with which energy is transferred from the first transducer to the ink volume.

Two or more transducers are arranged along different longitudinal sections of the ink channel. In this case, the transducers have to be energized at different times so that the first transducer will perform its compression stroke when the positive (biasing) pressure wave which has been generated by the second transducer has propagated into the section of the ink channel where the first transducer is situated. Of course, it is possible to employ three or more transducers arranged along the ink channel. Further, it is possible to provide a plurality of pairs of transducers along the ink channel such that the transducers of each pair are opposed to one another on the top and bottom sides of the ink channel and are energized synchronously.

It is not necessary that the depth of the ink channel is constant over the entire length. For example, the depth of the ink channel may be increased towards the nozzle. Then, the transducers located remote from the nozzle will have a high efficiency because they cooperate with a shallow section of the ink channel, whereas the transducers located closer to the nozzle will have a high efficiency because of the pressure bias of the ink volume in the associated sections of the ink channel, and the section of the ink channel immediately adjacent to the nozzle will have a large depth, as is required for minimizing the reflection losses at the nozzle.

According to the invention the transducers are energized by nested voltage pulses, such that, when a droplet is to be generated, the transducer which is closest to the nozzle is the first to contract and the last to expand, whereas the transducer closest to the ink reservoir is the last to contract and the first to expand. In this case, the transducers will perform their suction strokes successively, so that a negative pressure wave propagates from the nozzle towards the ink reservoir and is amplified each time it passes the transducer, the negative pressure wave being then reflected at the open end of the ink channel adjoining the ink reservoir, so that a reflected positive pressure wave propagates towards the nozzle and is successively amplified by the compression strokes of the transducers. By using this pattern for actuating the transducers, it is thus possible to exploit the reflection of the pressure wave at the open upstream end of the ink channel for amplifying the acoustic wave more efficiently.

In a drop-on-demand ink-jet system according to a preferred embodiment of the invention, at least one of the transducers is energized in response to a drop demand signal, and at least one other transducer is energized periodically, i.e. irrespective of whether or not the drop demand signal is present.

It is observed that no ink droplet will be expelled from the nozzle if the energy of the acoustic wave generated by the transducers is below a certain threshold level. Thus, when the transducer which is energized periodically is so arranged and/or controlled that the acoustic wave generated by this transducer alone is below the threshold level, an ink droplet will be generated only when the drop demand signal is present.

This embodiment has the advantage that the control logic which provides the high power output signal for periodically energizing the one transducer may be simplified significantly, because this control logic does not need to respond to the drop demand signal but is only required to provide a periodic pulse signal. In addition, in an integrated design comprising a plurality of nozzles with respectively associated ink channels and groups of transducers, the periodically energized transducers for all the nozzles may be powered by a common electrode or control line, so that the pattern of electric connections can be simplified significantly, which is particularly advantageous in case of a compact large-scale integrated device.

This particularly preferred embodiment of the invention is not limited to the case where the ink channel has a rectangular cross section. Thus, in a broader sense, the object of the invention can be achieved by an ink-jet system comprising an ink channel between an ink reservoir and a nozzle. A pressurizing device is arranged adjacent to the ink channel for generating in the ink liquid an acoustic pressure wave propagating in the ink channel, so that an ink droplet is expelled from the nozzle in response to a drop demand signal. The pressurizing device includes comprise at least two electromechanical transducers energized at different times, and at least one of said transducers is energized periodically, irrespective of the presence or absence of the drop demand signal, whereas at least one other transducer is energized in response to the drop demand signal.

The transducer or transducers which are energized in response to the drop demand signal may be kept silent when the drop demand signal is absent. Preferably, however, the signal applied to this transducer is also derived from a periodic pulse signal, and the polarity of this pulse signal is reversed in response to the drop demand signal. Thus, the acoustic waves generated by the totality of the transducers show constructive interference in order to produce an ink droplet when the drop demand signal is present, and they show destructive interference so that no droplet is generated, when the drop demand signal is absent. In this case, the acoustic wave which would be generated by the periodically energized transducer alone can have a comparatively large amplitude above the threshold level, so that a high level of acoustic energy can be achieved when the generation of a droplet is desired. In addition, the electronic control logic can be simplified further because the high voltage pulse signals to be applied to all transducers can be derived from periodic signals and the only effect of the drop demand signal is to change the polarity of one of these pulse signals. The timing at which the polarity is reversed in response to the drop demand signal is not critical, because the exact timings at which the transducers are actuated is determined by the pulses of the periodic signals, so that a stable drop generation can be achieved with a simple control logic.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
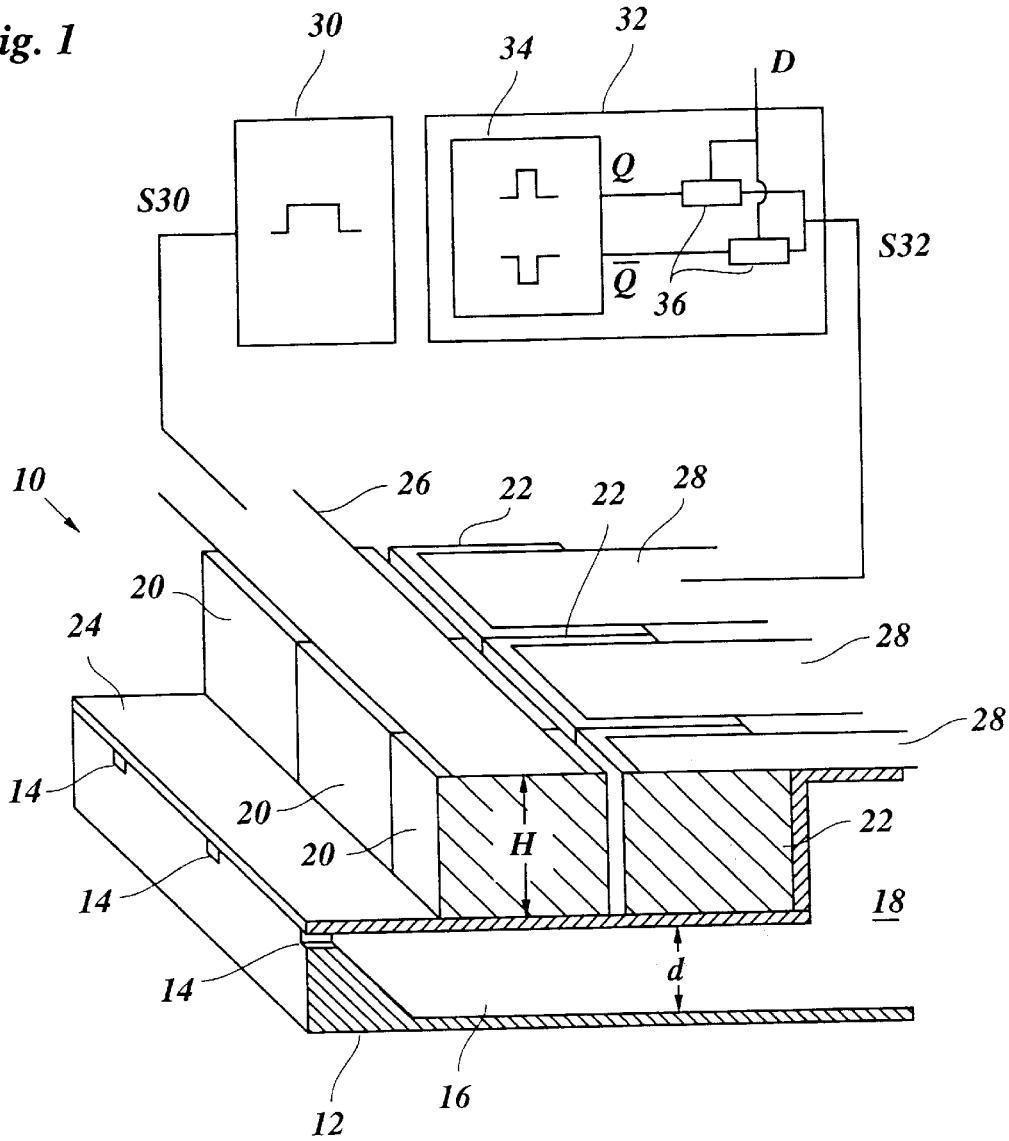
FIG. 1 is a cut-away perspective view of an ink-jet system according to the invention.

FIG. 1 shows an ink-jet system in the form of an integrated multiple-nozzle printhead 10 which has a plurality of drop-generating units arranged on a common substrate 12. Each drop-generating unit comprises a nozzle 14, an ink channel 16 connecting the associated nozzle to a common ink reservoir 18 and two piezoelectric elements 20, 22 which are disposed along the top side of the ink channel 16 and serve as electromechanical transducers for pressurizing the ink liquid in the ink channel 16. The ink channels 16 of the individual drop generating units are formed by grooves in the top surface of the substrate 12 and are separated from one another by vertical walls (not shown). The top sides of the nozzles 14 and the ink channels 16 are defined by a flexible cover plate 24.

The main portion of the ink channel 16 disposed below the piezoelectric elements 20, 22 has a rectangular cross-section, and the front end of the ink channel is tapered toward the nozzle 14. The depth d of the ink channel 16 is larger than the height of the nozzle 14 and has been selected to provide an appropriate ratio between the cross-sectional areas of the nozzle 14 and the ink channel 16 (the width of the ink channel being limited by the pitch of the drop-generating units).

The piezoelectric elements 20, 22 are formed by plate-like expansible members made of a piezoelectric material and provided with energizing electrodes 26, 28 at the top surface and a common ground electrode (not shown) at the bottom surface. The piezoelectric elements 22 are preferably separated from each other and each element 22 is positioned in such a way that it covers an ink channel 16.

The height H of the piezoelectric elements 20, 22 is significantly larger than the depth d of the ink channel 16. An upper limit for the height H is imposed by practical constraints. For example, it becomes more difficult to cut the piezoelectric element to the desired dimensions when the thickness thereof is increased.

When a voltage is applied for example to the electrode 28, the piezoelectric element 22 will tend to expand and will exert a pressure Pp on the flexible cover plate 24 and further on the ink volume in the ink channel 16. As a result, the cover plate 24 is caused to flex downward by a certain amount X, and the volume of the ink channel 16 is reduced accordingly.

Figure 2A:
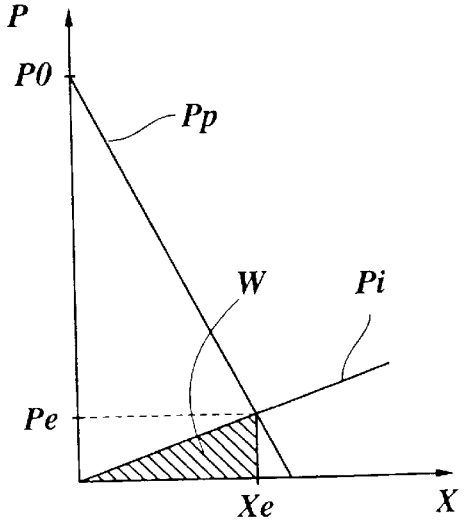
FIGS. 2A and 2B are pressure/displacement diagrams for a piezoelectric element and an ink volume pressurized thereby.

FIG. 2A is an idealized diagram which shows how the pressure Pp exerted by the piezoelectric element and the pressure Pi of the ink liquid depends on the displacement X of the cover plate 24 (the elastic force of which is neglected). The pressure Pp of the piezoelectric element starts from a comparatively high value P0 at the moment when the voltage is applied to the electrode 28 and the cover plate 24 has not yet been displaced, and then decreases linearly with the displacement X. The slope of the curve Pp is given by Ep/H, wherein Ep is the elastic module of the piezoelectric material. On the other hand, the pressure Pi of the ink liquid is initially zero and increases linearly with the displacement X, the slope being given by Ei/d, wherein Ei is the elastic module of the ink liquid. The displacement of the cover plate 24 will reach a value Xe at which there exists equilibrium between the pressures Pp and Pi. The mechanical work per unit area conferred to the ink liquid is represented by the hatched area W in FIG. 2A.

Figure 2B:
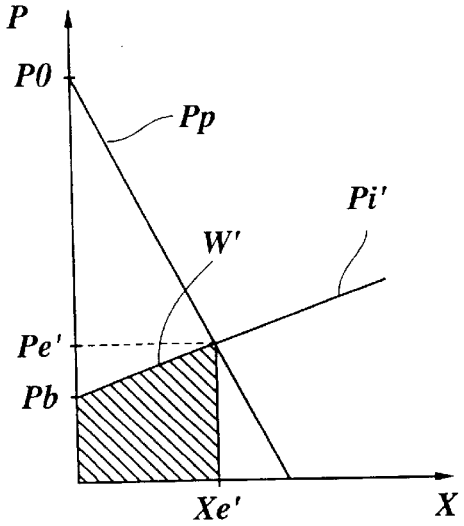

FIG. 2B illustrates a situation in which the ink liquid has already a certain initial pressure or bias pressure Pb. Accordingly, the curve Pi' representing the pressure of the ink liquid is shifted by the amount Pb. It is readily seen that the work W' conferred to the ink liquid (hatched area in FIG. 2B) is significantly larger than in the case illustrated in FIG. 2A.

The ink-jet system illustrated in FIG. 1 takes advantage of this effect in the following manner.

One piezoelectric element is used for creating the initial bias pressure Pb in the section of the ink channel 16 underneath the other piezoelectric element. Then, the electrode of the other piezoelectric element is energized in order to confer a higher amount of energy (corresponding to the work W') to the ink liquid. The mechanical energy of the piezoelectric elements is thus transformed into acoustic energy with high efficiency. When the wave front of the high pressure wave propagating in the ink channel 16 reaches the nozzle 14, this energy is efficiently transformed into kinetic energy of the ink droplet, because the cross section of the ink channel 16 is so dimensioned that energy losses due to the reflection of the acoustic wave at the nozzle 14 are minimized.

As is shown in FIG. 1, the electrode 26 which is common to the piezoelectric elements 20 of all drop generating units, is connected to a drive circuit 30, and each of the electrodes 28 is connected to another drive circuit 32 which receives a drop demand signal D.

Figure 3:
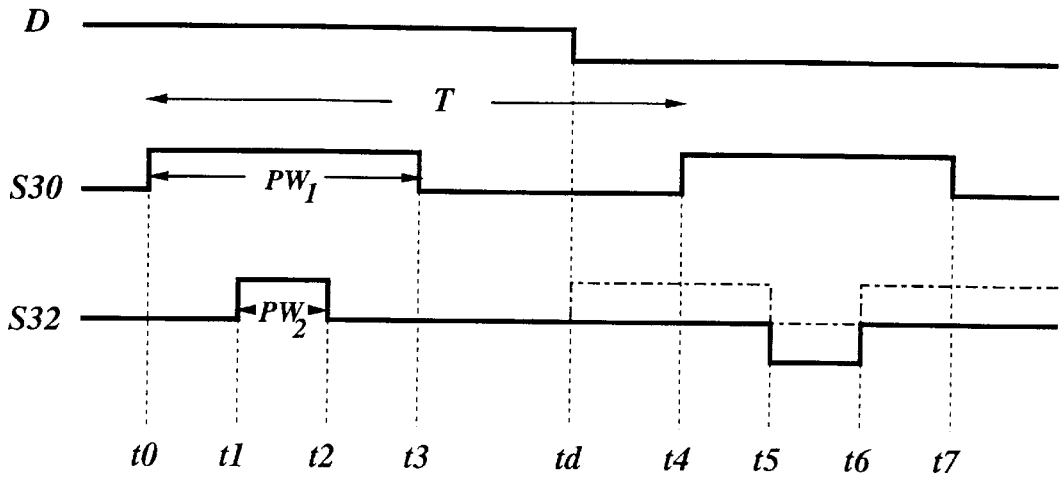
FIG. 3 is a time chart of signals to be supplied to the piezoelectric elements of the ink-jet system shown in FIG. 1.

FIG. 3 is a time chart illustrating exemplary wave forms of the drop demand signal D and the output signals S30 and S32 of the drive circuits 30 and 32. The drive circuit 30 outputs a periodic pulse signal with a fixed period T and a certain pulse width PW1, irrespective of whether or not the drop demand signal D is present. The drive circuit 32 generates a pulse signal which has the same period T. The centers of the pulses of this pulse signal are identical with the centers of the pulses of the signal S30, but the pulse width PW2 of the signal S32 is only one third of the pulse width PW1. When the drop demand signal D is present, then the pulse of the signal S32 has the same polarity as the pulses of the signal S30, and when the drop demand signal D is absent, the pulses of the signal S32 have the opposite polarity.

Figure 4:
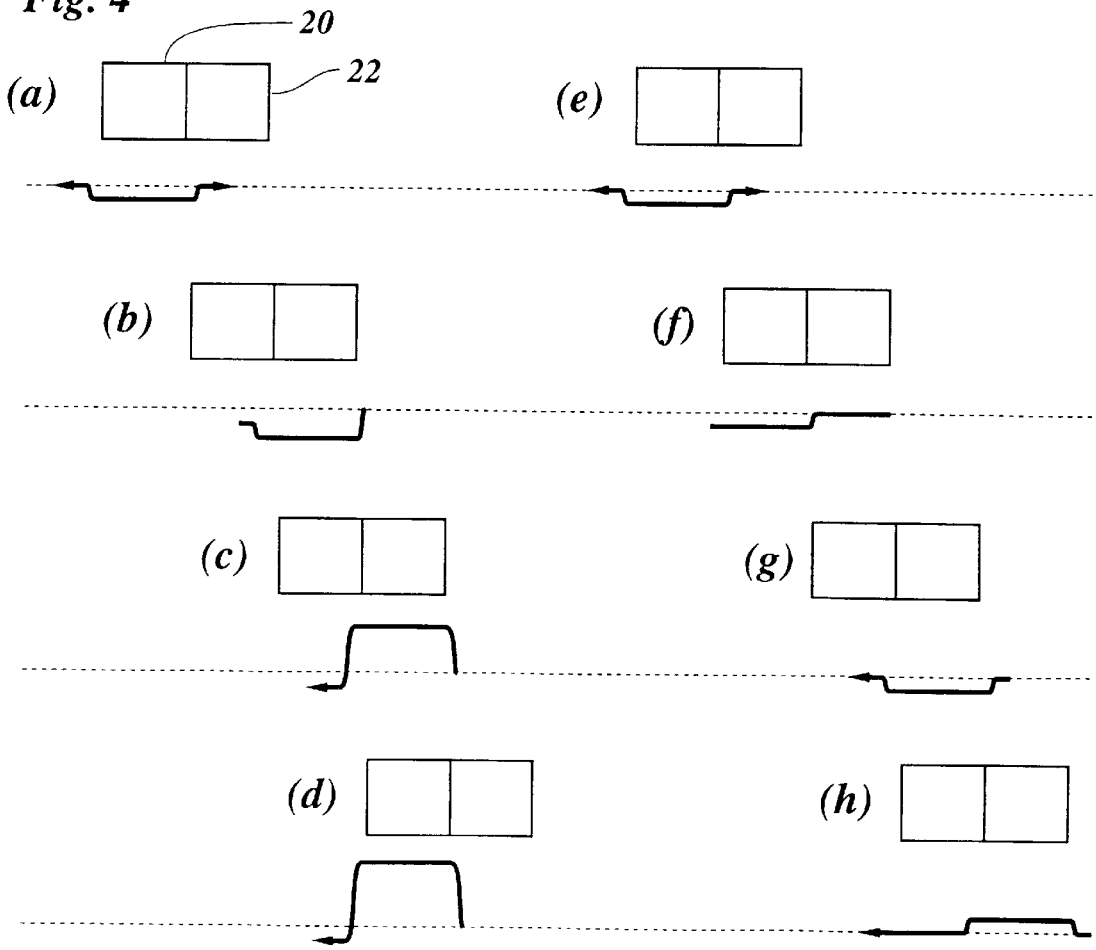
FIGS. 4(*a*)–(*h*) illustrate the propagation and amplification of an acoustic wave in the ink channel of the system shown in FIG. 1.

The operation of the ink-jet system according to FIG. 1 will now be explained in detail with reference to FIGS. 3 and 4. FIG. 4 symbolizes the propagation of an acoustic pressure wave in the ink channel 16 relative to the piezoelectric elements 20, 22 for each of the time points t0–t7 indicated in FIG. 3.

At the time t0, the signal S30, i.e. the voltage applied to the electrode 26 changes such that the piezoelectric elements 20 are contracted. As a result, a negative pressure wave is generated below the piezoelectric element 20, as is shown in FIG. 4(*a*). This negative pressure wave will spread in both directions.

At the time t1, the right wave front of the negative pressure wave has reached the right end of the piezoelectric element 22, i.e. the end adjacent to the ink reservoir 18. At this instant, the signal S32, i.e. the voltage applied to the electrode 28 of the drop generating system for which the drop demand signal D is present, is also changed so that this piezoelectric element 22 is also contracted. As a result, the negative pressure wave below the piezoelectric element 22 is amplified, as illustrated in FIG. 4(*b*).

Almost at the same instant the right wave front reaches the upstream end of the ink channel 16 adjoining the ink reservoir 18. At this open end, the negative pressure wave is reflected with a phase shift of 180, so that the reflected wave has a positive pressure.

When the wave front of this positive pressure wave again reaches the borderline between the piezoelectric elements 20 and 22, at the time t2, the signal S32 drops to zero. As a result, the piezoelectric element 22 expands, and the high pressure wave is amplified again as is shown in FIG. 4(*c*).

At the time t3, the positive pressure wave has travelled into the section of the ink channel 16 below the piezoelectric element 20. At this instant, the signal S30 drops to zero, and the piezoelectric element 20 expands so that the positive pressure wave is amplified once more. Thus, an acoustic wave carrying a high amount of energy will propagate towards the nozzle 14 and will cause the creation of the desired ink droplet.

The operation of the piezoelectric elements in the absence of the drop demand signal D is illustrated in FIGS. 4(*e*)–(*h*).

At the time t4, the piezoelectric element 20 is energized in the same manner as described above. FIG. 4(*e*) is therefore equivalent to FIG. 4(*a*).

At the time t5, the signal S32 assumes a negative value, so that the associated piezoelectric element 22 will expand. As a result, the negative pressure wave generated at the time t4 is substantially cancelled by destructive interference (FIG. 4(*f*)).

At the time t6, the signal S32 raises again to zero so that the piezoelectric element 22 is contracted to its rest position. As a result, a negative pressure wave will propagate towards the piezoelectric element 20, as is shown in FIG. 4(*g*).

At the time t7, the signal S34 drops to zero and the piezoelectric element 20 expands, so that the negative pressure wave is cancelled by destructive interference. Thus, no substantial pressure will be observed at the nozzle 14.

Since the system of ink in the nozzle and in particular the meniscus of the ink liquid in the nozzle 14 has a certain stability, it is not necessary that the acoustic wave is cancelled completely when the drop demand signal is absent. It is sufficient that the amplitude of the acoustic wave is reduced to such an extent that no droplet will be generated.

It may therefore be advantageous to modify the arrangement in such a manner that the piezoelectric element 20 provides more power than the element 22. This can be achieved by increasing the output voltage of the drive circuit 30 in comparison to the output voltage of the drive circuit 32. Since the drive circuit 32 must respond to the drop demand signal D, it will be appreciated that it is advantageous if this drive circuit can be operated at a lower voltage.

The embodiment which has been described above may be modified in various ways. For example, the piezoelectric elements 20 and 22 may have different lengths. For the reasons indicated above, it will be preferable to provide a larger length for the piezoelectric element 20. Of course, the timings of the signals S30 and S32 must be adapted to the respective lengths of the piezoelectric elements.

While, in the embodiment described above, the signal S32 is a tri-state signal, a bi-state signal may also be employed, as is indicated by the dot-dashed line in FIG. 3. This modified waveform of the signal S32 may be derived from a periodic pulse signal by inverting the polarity of this periodic pulse signal in accordance with the drop demand signal D. In this case, the piezoelectric element 22 will perform additional retraction and expansion strokes, for example at the time td in FIG. 3. These additional strokes however are not strong enough to create an ink droplet, so that they have no adverse effect on the performance of the system.

The drive circuit 32 may for example be implemented by a pulse generator 34 which provides a periodic pulse signal Q and by electronic switches 36 which connect the electrode 28 alternatingly to the output Q and to the inverted output Q of this pulse generator in response to the drop demand signal D. In this case, the power devices for energizing all piezoelectric elements may be formed by simple pulse generators which operate with a fixed frequency and pulsewidth, and the drop demand signal D is only applied to the electronic switches 36. These switches may be comparatively slow, because the inversion of the signal S32 may occur at any time between t3 and t4.

If the power of the piezoelectric element 20 is made small enough, so that this element alone is not capable of generating an ink droplet, then it is also possible to suppress the pulses of the signal S32 completely when the drop demand signal D is absent.

Other possible modifications of the described embodiment will readily occur to a person skilled in the art. For example, the function principle described above may easily by extended to arrangements with three or more piezoelectric elements for each ink channel. It is also possible to alter the positions of the transducer 20 which is energized periodically and the transducer 22 which is energized in response to the drop demand signal in such a way that the latter transducer 22 is closer to the nozzle than the other transducer 20. In this case it is clear that energization should be changed accordingly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink-jet system comprising:

an ink channel disposed between an ink reservoir and a nozzle for forming an ink droplet;

pressurizing means arranged adjacent to the ink channel for generating in an ink liquid an acoustic pressure wave propagating in the ink channel for expelling the ink droplet from the nozzle;

said ink channel having a substantially rectangular cross section and a depth d which is larger relative to a height of the nozzle, such that energy losses due to reflection of an acoustic wave at the transition from the ink channel to the nozzle are minimized;

said pressurizing means including a first electromechanical transducer with a plate-like expansible member, the first electromechanical transducer having a height H in a direction of the depth of the ink channel wherein a ratio of the height H relative to the depth d is smaller relative to a ratio of an elastic module of the plate-like expansible member relative to an elastic module of the ink liquid, and at least one second electromechanical transducer arranged at said ink channel and energized to create a pressure bias in the ink liquid before the ink liquid is pressurized by the first electromechanical transducer, wherein both the first and second electromechanical transducers are energized by nested pulse-like voltage signals, such that each of the first and second electromechanical transducers is first contracted and then expanded;

wherein the first and second electromechanical transducers sequentially arranged along the ink channel are contracted one after the other in an order from the nozzle towards the ink reservoir and are then expanded one after the other in a reverse order from the ink reservoir towards the nozzle by the nested pulse-like voltage signals.

2. An ink-jet system comprising:

an ink channel disposed between an ink reservoir and a nozzle for forming an ink droplet;

pressurizing means arranged adjacent to the ink channel for generating in an ink liquid an acoustic pressure wave propagating in the ink channel for expelling the ink droplet from the nozzle;

said ink channel having a substantially rectangular cross section and a depth d which is larger relative to a height of the nozzle, such that energy losses due to reflection of an acoustic wave at the transition from the ink channel to the nozzle are minimized;

said pressurizing means including a first electromechanical transducer with a plate-like expansible member the first electromechanical transducer having a height H in a direction of the depth of the ink channel wherein a ratio of the height H relative to the depth d of the ink channel is smaller relative to a ratio of an elastic module of the plate-like expansible member relative to an elastic module of the ink liquid, and at least one second electromechanical transducer arranged at said ink channel and energized to create a pressure bias in the ink liquid before the ink liquid is pressurized by the first electromechanical transducer, wherein both the first and second electromechanical transducers are energized by nested pulse-like voltage signals, such that each of the first and second electromechanical transducers is first contracted and then expanded;

wherein the first and second electromechanical transducers sequentially arranged along the ink channel are contracted one after the other in an order from the nozzle towards the ink reservoir and are then expanded one after the other in a reverse order from the ink reservoir towards the nozzle by said nested pulse-like voltage signals; and wherein at least one of the first and second electromechanical transducers is energized in response to presence of a drop demand signal and wherein at least another of the first and second electromechanical transducers is energized periodically, irrespective of the presence or absence of the drop demand signal.

3. The ink-jet system according to claim 2, wherein the first or second electromechanical transducer that is energized periodically irrespective of the presence or absence of the drop demand signal is located closest to the nozzle.

4. The ink-jet system according to claim 3, wherein the nested pulse-like voltage signals are comprised of a first pulse-like voltage signal and a second pulse-like voltage signal, wherein the second electromechanical transducer is energized in response to presence of the drop demand signal receives the second pulse-like voltage signal with such a timing in relation to the timing of the first pulse-like voltage signal applied to the first electromechanical transducer that the acoustic waves generated by each of the first and second electromechanical transducers constructively interfere when the drop demand signal is present and destructively interfere when the drop demand signal is absent.

5. The ink-jet system according to claim 4, wherein the second pulse-like voltage signal applied to the second electromechanical transducer in response to presence of the drop demand signal is a tri-state signal which includes either positive or negative pulses in relation to a zero-potential, depending on a state of the drop demand signal.

6. The ink-jet system according to claim 4, wherein a drive circuit for energizing the second electromechanical transducer in response to presence of the drop demand signal comprises a pulse generator for generating the second pulse-like voltage signal and means for inverting the second pulse-like voltage signal dependent on a presence or an absence of the drop demand signal.

7. The ink-jet system according to claim 4, wherein a drive circuit for energizing the first electromechanical transducer in response to presence of the drop demand signal comprises a pulse generator for generating the first pulse-like voltage signal and means for inverting the first pulse-like voltage signal dependent on a presence or an absence of the drop demand signal.

8. The ink-jet system according to claim 3, wherein the nested pulse-like voltage signals are comprised of a first pulse-like voltage signal and a second pulse-like voltage signal, wherein the second electromechanical transducer is energized in response to the drop demand signal receives the second pulse-like voltage signal with such a polarity in relation to the polarity of the first pulse-like voltage signal applied to the first electromechanical transducer that the acoustic waves generated by each of the first and second electromechanical transducers constructively interfere when the drop demand signal is present and destructively interfere when the drop demand signal is absent.

9. The ink-jet system according to claim 2, wherein the nested pulse-like voltage signals are comprised of a first pulse-like voltage signal and a second pulse-like voltage signal, wherein the second electromechanical transducer is energized in response to presence of the drop demand signal receives the second pulse-like voltage signal with such a timing in relation to the timing of the first pulse-like voltage signal applied to the first electromechanical transducer that the acoustic waves generated by each of the first and second electromechanical transducers constructively interfere when the drop demand signal is present and destructively interfere when the drop demand signal is absent.

10. The ink-jet system according to claim 9, wherein the second pulse-like voltage signal applied to the second electromechanical transducer in response to presence of the drop demand signal is a tri-state signal which includes either positive or negative pulses in relation to a zero-potential, depending on a state of the drop demand signal.

11. The ink-jet system according to claim 9, wherein a drive circuit for energizing the second electromechanical transducer in response to presence of the drop demand signal comprises a pulse generator for generating the second pulse-like voltage signal and means for inverting the second pulse-like voltage signal dependent on a presence or an absence of the drop demand signal.

12. The ink-jet system according to claim 2, wherein the nested pulse-like voltage signals are comprised of a first pulse-like voltage signal and a second pulse-like voltage signal, wherein the second electromechanical transducer is energized in response to the presence of drop demand signal receives the second pulse-like voltage signal with such a polarity in relation to the polarity of the first pulse-like voltage signal applied to the first electromechanical transducer that the acoustic waves generated by each of the first and second electromechanical transducers constructively interfere when the drop demand signal is present and destructively interfere when the drop demand signal is absent.

13. An ink-jet system comprising:

an ink channel formed between an ink reservoir containing an ink liquid and a nozzle for forming an ink droplet;

said ink channel having a substantially rectangular cross section and a depth d which is larger relative to a height of the nozzle;

a first electromechanical transducer with a plate-like expansible member the first electromechanical transducer having a height H in a direction of the depth of the ink channel wherein a ratio of the height H relative to the depth d is smaller relative to a ratio of an elastic module of the plate-like expansible member relative to an elastic module of the ink liquid; and at least a second electromechanical transducer arranged at said ink channel and energized to create a pressure bias (Pb) in the ink liquid before the ink liquid is pressurized by the first electromechanical transducer, wherein both the first and second electromechanical transducers are energized by nested pulse-like voltage signals, such that each transducer is first contracted and then expanded;

said first and second electromechanical transducers being arranged adjacent to the ink channel for generating in the ink liquid an acoustic pressure wave propagating in the ink channel for expelling the ink droplet from the nozzle;

said first and second electromechanical transducers sequentially arranged along the ink channel are contracted one after the other in an order from the nozzle towards the ink reservoir and are then expanded one after the other in a reverse order from the ink reservoir towards the nozzle by the nested pulse-like voltage signals.

14. The ink-jet system according to claim 13, wherein at least one of the first and second electromechanical transducers is energized in response to a presence of a drop demand signal and wherein at least another of the first and second electromechanical transducers is energized periodically, irrespective of the presence or absence of the drop demand signal.

15. The ink-jet system according to claim 14, wherein the first or second electromechanical transducer that is energized periodically irrespective of the presence or absence of the drop demand signal is located closest to the nozzle.

16. The ink-jet system according to claim 15, wherein the nested pulse-like voltage signals are comprised of a first pulse-like voltage signal and a second pulse-like voltage signal, wherein the second electromechanical transducer is energized in response to presence of the drop demand signal receives the second pulse-like voltage signal with such a timing in relation to the timing of the first pulse-like voltage signal applied to the first electromechanical transducer that the acoustic waves generated by each of the first and second electromechanical transducers constructively interfere when the drop demand signal is present and destructively interfere when the drop demand signal is absent.

17. The ink-jet system according to claim 16, wherein the second pulse-like voltage signal applied to the second electromechanical transducer in response to presence of the drop demand signal is a tri-state signal which includes either positive or negative pulses in relation to a zero-potential, depending on a state of the drop demand signal.

18. The ink-jet system according to claim 16, wherein a drive circuit for energizing the second electromechanical transducer in response to presence of the drop demand signal comprises a pulse generator for generating the second pulse-like voltage signal-and means for inverting the second pulse-like voltage signal dependent on a presence or an absence of the drop demand signal.

19. The ink-jet system according to claim 16, wherein a drive circuit for energizing the first electromechanical transducer in response to presence of the drop demand signal comprises a pulse generator for generating the first pulse-like voltage signal and means for inverting the first pulse-like voltage signal dependent on a presence or an absence of the drop demand signal.

20. The ink-jet system according to claim 15, wherein the nested pulse-like voltage signals are comprised of a first pulse-like voltage signal and a second pulse-like voltage signal, wherein the second electromechanical transducer is energized in response to presence of the drop demand signal receives the second pulse-like voltage signal with such a polarity in relation to the polarity of the first pulse-like voltage signal applied to the first electromechanical transducer that the acoustic waves generated by each of the first and second electromechanical transducers constructively interfere when the drop demand signal is present and destructively interfere when the drop demand signal is absent.

21. The ink-jet system according to claim 14, wherein the nested pulse-like voltage signals are comprised of a first pulse-like voltage signal and a second pulse-like voltage signal, wherein the second electromechanical transducer is energized in response to presence of the drop demand signal receives the second pulse-like voltage signal with such a timing in relation to the timing of the first pulse-like voltage signal applied to the first electromechanical transducer that the acoustic waves generated by each of the first and second electromechanical transducers constructively interfere when the drop demand signal is present and destructively interfere when the drop demand signal is absent.

22. The ink-jet system according to claim 21, wherein the second pulse-like voltage signal applied to the second electromechanical transducer in response to presence of the drop demand signal is a tri-state signal which includes either positive or negative pulses in relation to a zero-potential, depending on a state of the drop demand signal.

23. The ink-jet system according to claim 21, wherein a drive circuit for energizing the second electromechanical transducer in response to presence of the drop demand signal comprises a pulse generator for generating the second pulse-like voltage signal and means for inverting the second pulse-like voltage signal dependent on a presence or an absence of the drop demand signal.

24. The ink-jet system according to claim 14, wherein the nested pulse-like voltage signals are comprised of a first pulse-like voltage signal and a second pulse-like voltage signal, wherein the second electromechanical transducer is energized in response to presence of the drop demand signal receives the second pulse-like voltage signal with such a polarity in relation to the polarity of the first pulse-like voltage signal applied to the first electromechanical transducer that the acoustic waves generated by each of the first and second electromechanical transducers constructively interfere when the drop demand signal is present and destructively interfere when the drop demand signal is absent.

* * * * *